US006227806B1

(12) United States Patent
Libfeld

(10) Patent No.: US 6,227,806 B1
(45) Date of Patent: May 8, 2001

(54) LIFT PUMP GUARD

(75) Inventor: Felix Libfeld, Longmeadow, MA (US)

(73) Assignee: Stanadyne Automotive Corp., Windsor, CT (US)

( * ) Notice: Subject to any disclaimer, the term of this patent is extended or adjusted under 35 U.S.C. 154(b) by 0 days.

(21) Appl. No.: 09/393,644

(22) Filed: Sep. 10, 1999

(51) Int. Cl.[7] ..... F04B 49/00; F04B 49/06

(52) U.S. Cl. ..... 417/36; 417/12; 417/44.1; 417/44.2; 417/53

(58) Field of Search ..... 417/36, 12, 44.1, 417/44.2, 53; 361/30

(56) References Cited

U.S. PATENT DOCUMENTS 4,430,980 * 2/1984 Pidgeon ..... 123/497
4,841,404 * 6/1989 Marshall et al. ..... 361/30
4,905,641 * 3/1990 Miller ..... 123/187.5 R
5,078,577 * 1/1992 Heckman ..... 417/36
5,789,879 * 8/1998 Cook ..... 417/4

* cited by examiner

*Primary Examiner*—Timothy S. Thorpe
*Assistant Examiner*—Michael K. Gray
(74) *Attorney, Agent, or Firm*—Alix, Yale, & Ristas, LLP

(57) ABSTRACT

Lift pump guard for a pump operable by an electrical motor. The lift pump guard monitors variable parameters and actuates a relay to electrically terminate operation of the pump motor when the pump is dry running. Also a method of protecting a pump from dry running compares a measured parameter to a predetermined value and terminates operation based on the comparison.

16 Claims, 4 Drawing Sheets

LIFT PUMP GUARD

BACKGROUND OF THE INVENTION

The present invention relates to a lift or transfer pump for supplying fuel from a tank to an internal combustion engine. More particularly, the invention relates to a device and method to prevent dry running of a lift pump.

Internal combustion engine powered devices typically include a lift pump to transfer fuel from a remote tank to the engine fuel supply. The engine fuel supply may comprise a carburetor, a fuel injection system, or a high pressure fuel injection pump. While lift pumps may be mechanically driven, electric motor powered lift pumps have become common place. These electric powered lift pumps are energized to operate whenever the engine electrical system is in a start or run condition. The lift pump, or a downstream portion of the fuel system, will include a pressure switch or a pressure regulator and return line to prevent "dead heading" of the lift pump. Thus, it is possible for the fuel pump to continue operating when the ignition is in the on condition but the engine is not operating.

The ability of the lift pump to operate when the engine is not also operating leads to a number of potential problems. In the case of an ignition switch inadvertently left in the on position with the engine not operating, the lift pump will operate and drain the battery. Further, continuous operation of the lift pump circulates fuel through the fuel system and back to the tank leading to fuel heating. More seriously, if the fuel tank empties so that the lift pump runs dry, the continuously operating lift pump motor can overheat. In severe cases of dry running, the motor commutator melts, requiring costly and time consuming replacement of the lift pump before the vehicle can be restarted.

SUMMARY OF THE INVENTION

Briefly stated, the invention in a preferred form is an electric lift pump guard which prevents unintended dry running of the lift pump. In one embodiment, the lift pump guard monitors current flowing through the electric motor powering the lift pump. This is accomplished by monitoring the voltage drop across a precision value sensing resistor within the lift pump guard circuit. This voltage is compared with a standard or threshold voltage. Under normal conditions, when the lift pump is pumping, the measured voltage is greater than the threshold voltage. When the lift pump motor is operating but no fuel is being pumped, the measured voltage falls below the threshold voltage creating a low voltage condition. After a predetermined time the low voltage condition will open the normally closed connection of a relay, thereby disconnecting the electric motor of the lift pump from the power supply circuit. The relay remains in the off condition until it is reset. Resetting of the relay is accomplished by interrupting the power supply to the lift pump guard.

In an alternative embodiment of a lift pump guard for a diesel engine, the pump guard monitors the voltage at an electric shutoff (ESO) solenoid of a high pressure fuel injection pump as well as at an oil pressure switch. The voltages are compared to preestablished values. As long as one of the measured voltages is above the preestablished value, the normally open connection of a relay is held closed, thereby energizing the lift pump electric motor. When the engine runs out of fuel it stalls, the voltage values are below the predetermined level and the relay will de-energize, terminating electricity to the lift pump motor. This embodiment preferably includes a momentary contact switch which can be used to manually activate the lift pump to allow purging of air from the fuel system.

Preferably, the lift pump guard in any embodiment is designed so that it may comprise a sealed housing. Wiring leads or harnesses extend from the housing and via detachable electrical connectors allow the lift pump guard to be added to existing or new electrical systems quickly and inexpensively.

An object of the invention is to provide an automatic shutoff device for a lift pump of a fuel supply system.

Another object of the invention is to provide an automatic shutoff device to prevent dry running of a lift pump which device is compact and can be efficiently incorporated into presently existing wiring harnesses or electrical connections.

A further object of the invention is to provide a new and improved method for monitoring and controlling a lift pump to prevent dry running.

Other objects and advantages of the invention will become apparent from the specification and the drawings.

BRIEF DESCRIPTION OF THE DRAWINGS

The present invention may be better understood and its numerous objects and advantages will become apparent to those skilled in the art by reference to the accompanying drawings, in which.

DETAILED DESCRIPTION OF THE PREFERRED EMBODIMENT

Figure 1:
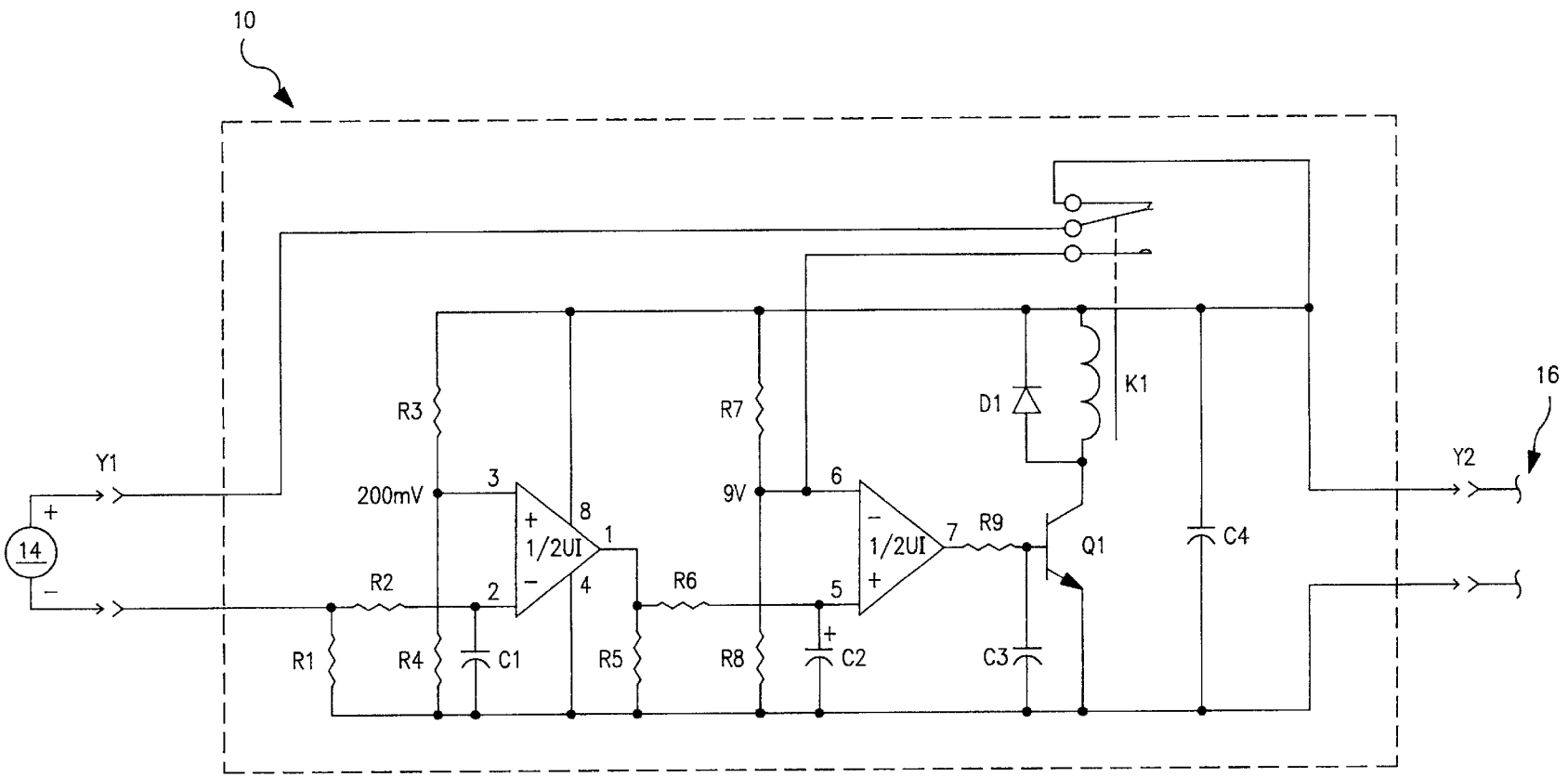
FIG. 1 is an electrical schematic diagram of an embodiment of a lift pump guard.

With reference to the drawings, wherein like numerals represent like parts throughout the several figures, a preferred lift pump guard in accordance with the present invention is generally designated by the numerals 10 or 100. The lift pump guard 10, 100, is designed for lift pumps 12 powered by direct current electrical motors 14. While the following description refers to the use of a lift pump guard 10, 100 in a vehicular environment, it should be understood that the lift pump guard 10, 100 may also be employed in any environment where there is a concern about dry running of a pump 12, such as, for example, stationary power generators powered by internal combustion engines.

The lift pump guard will be described with respect to a 12 volt direct current (DC) power supply which is commonly used in marine and automotive applications of internal combustion engines. The 12 VDC is commonly stored in a battery and/or generated by an alternator and rectifier attached to the electrical system of the internal combustion engine.

Typically, the engine electrical wiring harness portion leading to the lift pump 12 is selectively energized, that is, that portion 16 of the wiring harness is only energized when the ignition is in the start or run position. When the ignition is in the off position, no electrical current is supplied to that portion 16 of the wiring harness. As shown in FIG. 1, the inventive lift pump guard 10is disposed between the engine wiring harness portion 16 and the lift pump 12. The use of detachable electrical connectors Y1, Y2 allows the lift pump guard 10 to be quickly and easily connected to the lift pump 12 and wiring harness portion 16.

A normally closed relay K1 in the pump guard 10 connects one leg of the electrical harness portion 16 to the lift pump motor 14. Thus, when the ignition is switched from an off position to a start or run position, the lift pump motor 14 is immediately energized through the pump guard 10 for fuel transfer.

Figure 4:
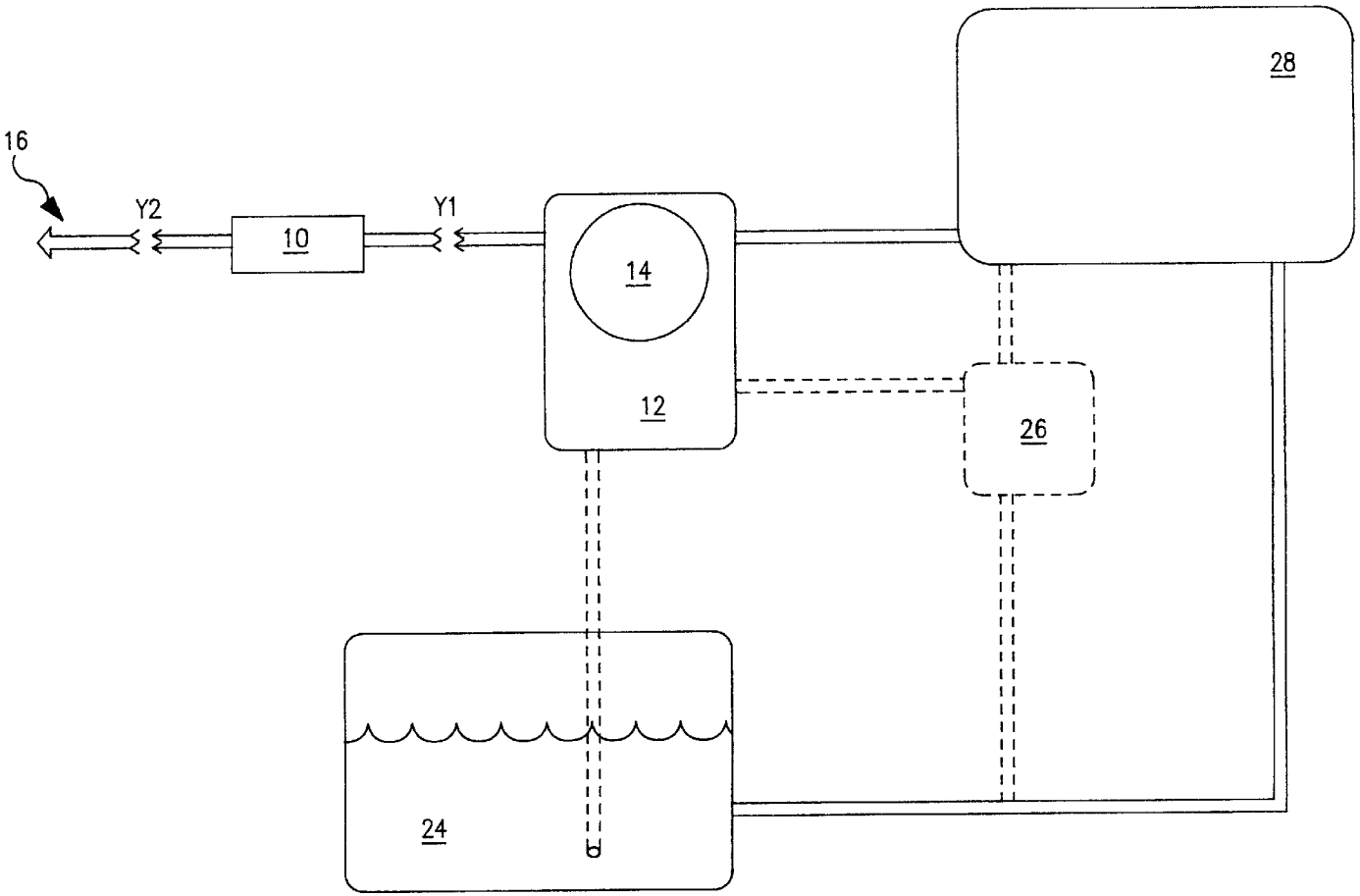
FIG. 4 is a schematic diagram of a fuel system incorporating one embodiment of a lift pump guard.

The lift pump guard 10 monitors current flowing through the lift pump motor 14 by measuring the voltage drop across precision value sense resistor R1 at different lift pump operating conditions. Preferably, resistor R1 has a tolerance of 1% or better to ensure accurate measurement by the pump guard 10. When the lift pump 12 is transferring fuel from a fuel tank 24 to a high pressure fuel injection pump 26 or an engine 28 (shown in FIG. 4), or running "wet", the pump motor 14 will be under a load and, for example, draw approximately 2.5 amperes. Under these conditions resistor R1, and thereby input pin 2 of comparator U1, will be at a voltage of 250 mV. The input voltage at input pin 2 exceeds the 200 mV at input pin 3 which is set by resistors R3 and R4 functioning as a voltage divider. As long as the voltage at input pin 2 is greater than that of input pin 3, output pin 1 of comparator U1 will remain in a low state. When output pin 1 is in a low state, input pin 5 of comparator U1 will be at a voltage less than input pin 6. Therefore, output pin 7 of comparator U1 will be in a low state, transistor Q1 will be in an off state and relay K1 remains de-energized and in the normally closed condition. The lift pump motor 14 is accordingly supplied power from the electrical harness 16 through the normally closed connection of relay K1.

When the fuel tank 24 empties so that the lift pump 12 does not transfer fuel and therefore is running "dry", the motor 14 is under a lessened load and, for example, will draw approximately 1.5 amperes. Under these conditions, resistor R1, and thereby input pin 2 of comparator U1, will be at a voltage of 150 mV. This voltage is below the 200 mV on input pin 3 and therefore output pin 1 becomes energized. The voltage from output pin 1 charges capacitor C2 through resistor R6, maintaining a low voltage on pin 5 as long as capacitor C2 is charging. After a predetermined time capacitor C2 becomes charged, and the voltage on pin 5 of comparator U1 rises above 9 volts. When the voltage on input pin 5 exceeds the voltage on input pin 6, output pin 7 of comparator U1 becomes energized. The voltage supplied by output pin 7 causes transistor Q1 to turn on, thereby energizing relay K1. In the energized condition, the normally closed relay connection opens, stopping the flow of electric current from the engine harness 16 to the lift pump motor 14. Relay K1 remains energized until power to the engine harness portion 16 is interrupted, as by placing the ignition in the off position.

The RC circuit combination of resistor R6, capacitor C2 and the predetermined input voltage at pin 6 creates a delay of approximately 1 minute between the time the lift pump 12 starts to run dry and the time at which the relay K1 connection opens, shutting off the lift pump 12. This delay is short enough to prevent damage to the fuel pump 12 but long enough to accommodate minor fluctuations in current drawn by motor 14. Naturally, other combinations may be used to provide delays with different time periods.

While the lift pump guard as described comprises a comparator U1, an operation amplifier (not shown) may be substituted. Resistor R2 and capacitor C1 are used in the lift pump guard 10 to reduce any ripple produced by the motor 14. Resistor R5 provides a discharge path for capacitor C2. The normally open connection of relay K1 is used to lower the voltage on pin 6 of comparator U1 when the relay is switched, thereby minimizing chattering of the relay. Capacitors C3 and C4 function to prevent the lift pump motor 14 from turning off when the lift pump guard 10 is exposed to external electromagnetic radiation.

Figure 2A:
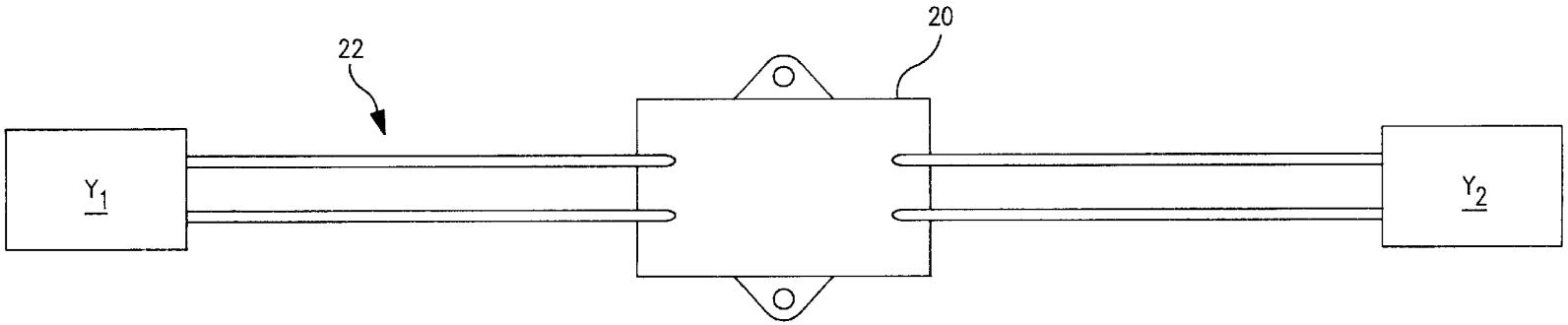
FIGS. 2*a* and 2*b* are overhead and side views, respectively, of the lift pump guard of FIG. 1 in a sealed enclosure.
Figure 2B:
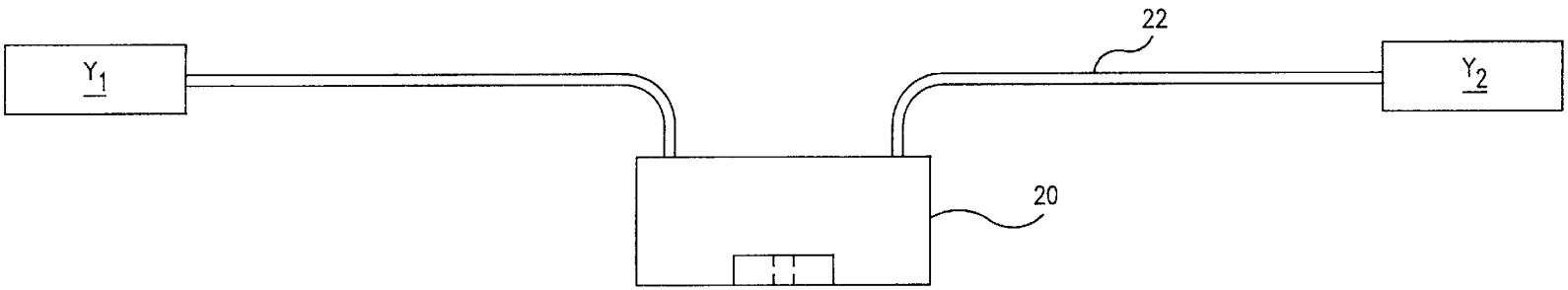

As shown in FIGS. 2*a* and 2*b*, the lift pump guard 10 may further comprise a housing or compact enclosure 20 which, for example, may be approximately 26 mm by 38 mm by 64 mm. The enclosure 20 may be environmentally sealed and include wire leads 22 connecting the pump guard 10 to detachable wiring harness connectors Y1, Y2. Each connector Y1, Y2 is preferably configured or polarized to prevent incorrect electrical connection of the lift pump guard 10 between the wiring harness 16 and the lift pump motor 14.

The above embodiment is described in the context of a lift pump 12 having a 12 volt direct current motor 14 operating with a normal current draw of approximately 2.5 amps and a dry running current draw of approximately 1.5 amps. It should be understood the invention encompasses use with other lift pumps with motors of different operating voltages and having different current draws and different threshold settings.

Figure 3:
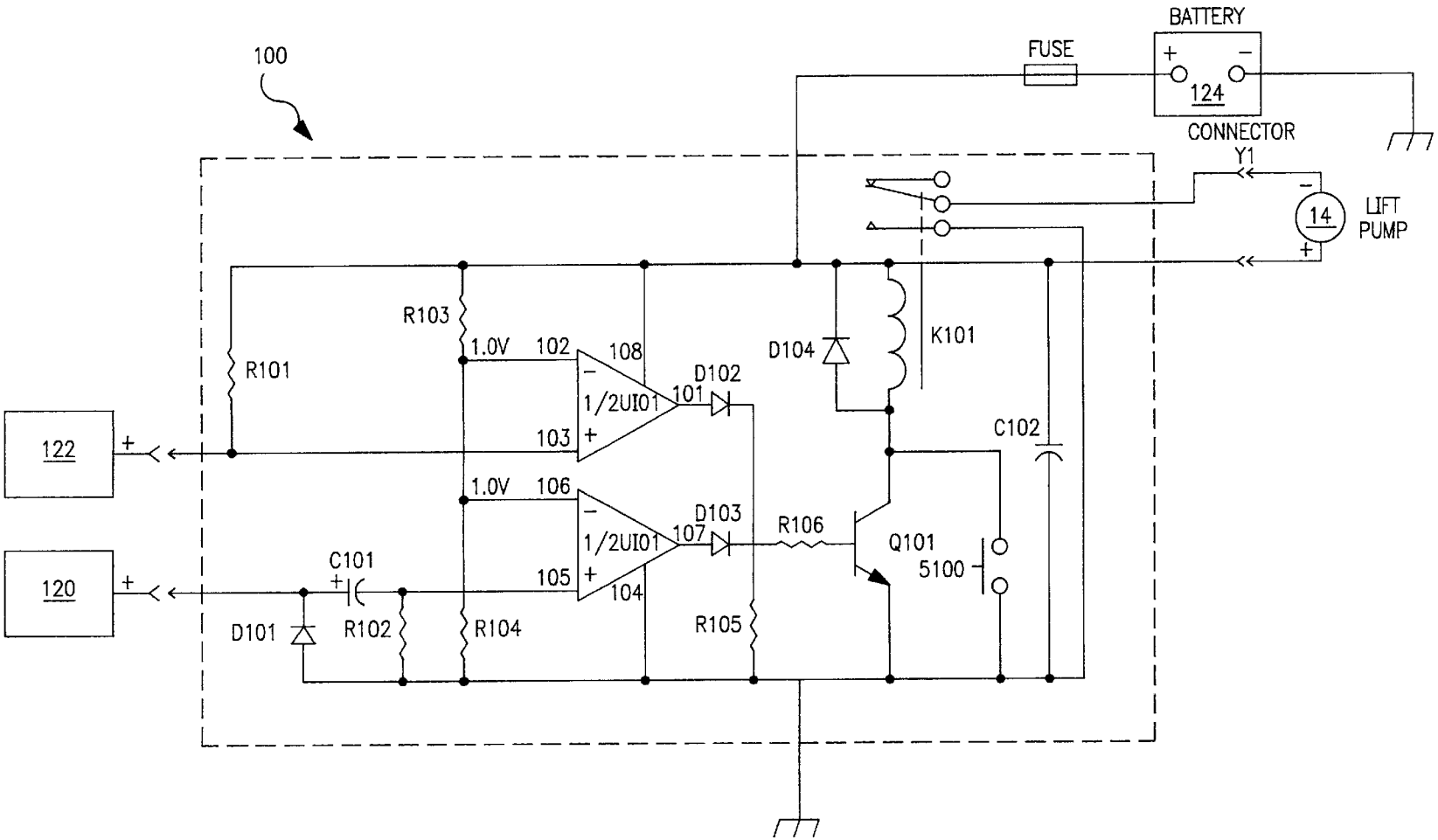
FIG. 3 is an electrical schematic diagram of an alternative embodiment of a lift pump guard.

A second embodiment of a lift pump guard 100 is shown in FIG. 3. This embodiment is especially adapted for use with diesel engines having a solenoid activated electric shutoff (ESO) 120 and oil pressure switch 122. Typically, the electric shutoff 120 will be found connected to a high pressure fuel injection pump 26 (see FIG. 4) to stop the flow of fuel to a diesel engine to thereby force engine shutdown. The oil pressure switch 122 will be operably connected to the engine lubrication system. The lift pump guard 100 is electrically disposed between the lift pump 12 and an engine wiring harness portion, shown in FIG. 3 as individual connections. The wiring harness portion includes connections to an electrical power source, shown as a battery 124 in FIG. 3, an electrical ground, and terminals on the oil pressure switch 122 and electric shut off 120. When a diesel engine is started, the oil pressure in the lubrication system increases over a short time period, typically about 30 seconds. At a predetermined pressure, the normally closed oil pressure switch 122 opens. Until the oil pressure switch 122 opens, there is no voltage available at the switch terminal.

The ESO solenoid 120 is energized to start the engine and must remain energized while the engine is operating. At engine startup, the ESO solenoid terminal supplies 11 volts to pin 105 of comparator U101. Resistors R103 and R104, functioning as a voltage divider, supply 1.0 volt to input pins 102 and 106. The 11 volt input at pin 105 is greater than the 1.0 volt threshold at pin 106 and allows a high voltage at output pin 107 of device U101. The high voltage at output pin 107, acting through diode D103 and resistor R106, turns on transistor Q101, which energizes relay K101, closing the normally open connection of the relay. Energized relay K101 completes the electrical circuit between the lift pump motor 14 and the vehicle harness portion, thereby energizing the pump 12 for transfer of fuel from the tank 24 to the high pressure fuel injection pump 26.

During the first 30 seconds after engine startup, capacitor C101 charges and the initial voltage of 11 volts at input pin 105 decays below 1.0 volt. Below 1.0 volt, the voltage on input pin 105 is insufficient to maintain comparator U101 output pin 107 in the energized state.

However, before the voltage at pin 105 has fallen below the threshold, the oil pressure switch 122 opens, placing a voltage at pin 103 above the comparator U101 threshold set by pin 102. The high voltage on pin 103 allows a high voltage at output pin 101. The high voltage at pin 101, acting through diode D102 and resistor R106 maintains transistor Q101 in the on state, thereby maintaining relay K101 and lift pump motor 14 in an energized state.

Thus at startup, pin 105 is above the comparator U101 threshold, but pin 103 is below the threshold. Within 30 seconds after engine startup, pin 105 is below the threshold, but pin 103 is above the threshold. As long as one of input pins 105 and 103 is energized above the threshold, one of output pins 101 and 107 will remain high, relay K101 will remain energized and lift pump motor 14 will continue to operate.

When the engine runs out of fuel the engine will stall and the oil pressure in the lubrication system will drop. Below the predetermined oil pressure, switch 122 will become closed so that input at pin 103 is at a low level. The voltage at input pin 105 previously decayed below the threshold level. The low voltage at input pins 103 and 105 causes output pins 101 and 107 of device U101 to become low, which then turns off transistor Q101 thereby de-energizing relay K101 and opening the electrical connection between the lift pump motor 14 and the wiring harness portion. Since the lift pump guard 100 will switch the lift pump motor 14 off after 30 seconds if the engine is not operating, this embodiment performs the additional function of preventing battery 124 rundown in situations wherein the ignition is left on but the engine is not operating.

In fuel systems for diesel powered engines, any air introduced into the fuel system during the changing of a fuel filter must be purged. While a delay of 1 minute before pump shutoff will usually be adequate for purging air from a diesel engine fuel system, the delay of 30 seconds in the above described embodiment is likely to be unacceptable. For this reason, the lift pump guard 100 preferably incorporates a manually activated air purging circuit. The air purging circuit incorporates a momentary contact switch S100. Switch S100 when depressed bypasses comparator U101 and transistor Q101, thereby energizing relay K101 to start the lift pump motor 14. As soon as the switch is released, the contact is broken and the lift pump is de-energized.

Diode D101 functions to protect comparator U101 input and capacitor C101 from excessive voltage, high voltage spikes or reverse polarities which may be generated by the ESO solenoid during shut off. Resistor R101 functions to maintain comparator U101 input pin 103 high in the event an oil pressure indicator light burns out. Resistor R101 also functions to prevent voltage "float" to input pin 103 caused by the mechanical oil pressure switch transitioning from an open to closed condition and vice versa. Diodes D102 and D103 prevent cross voltage on output pins 101 and 107. Capacitor C102 functions to filter RF noise. Naturally, an operation amplifier (not shown) may be used in place of the comparator U101.

While the above embodiment is described in the context of a lift pump 12 having a 12 volt direct current motor 14, it should be understood the invention encompasses use with lift pumps of different operating voltages having different threshold settings. While not shown, the lift pump guard 100 is preferably enclosed in an environmentally sealed housing and electrically connected with detachable wiring harness connectors in a manner similar to that shown in FIGS. 2*a* and 2*b*.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A lift pump guard for a lift pump operable by a direct current electrical motor selectively connected to a direct current power supply, said motor using a first current flow when said lift pump is pumping fluid and using a lower second current flow when said lift pump is not pumping fluid, said lift pump guard comprising:

a bistable relay electrically disposed between said motor and power supply with a normally resident first condition in which said motor is connected to said power supply and selectively actuatable to a second condition in which said motor is isolated from said power supply;

means for monitoring current flow through said motor and generating an output having a value dependent on said current flow; and means for comparing said value with a respective preestablished value to thereby selectively actuate said relay upon detection of said second current flow.

2. The guard of claim 1 wherein said electrical supply is about 12 volts.

3. The guard of claim 1 wherein said means for monitoring comprises a precision value sense resistor.

4. The lift pump guard of claim 1, comprising:

means for delaying actuation of said relay for a predetermined time interval after detection of said second current flow, whereby said relay is actuated said predetermined period of time after said lift pump guard has detected that said lift pump is not pumping fluid.

5. The guard of claim 4 wherein said delaying means comprises an RC circuit.

6. The guard of claim 1 enclosed by a compact housing and including leads electrically connected to said motor and said power supply.

7. A protected fuel supply pump system for an engine having a direct current electrical system, comprising:

a lift pump operable by a direct current electric motor electrically connectable to said electrical system and fluidly connected to draw fuel from a fuel tank and supply said fuel to said engine fuel supply; and a lift pump guard module electrically connectable between said motor and said electrical system, said lift pump guard module comprising:

a bistable relay with a normally resident first condition which electrically connects said electrical system and said lift pump and selectively actuatable to a second condition which electrically isolates said electrical system and said lift pump;

a measuring circuit to monitor a lift pump dependent variable parameter and generate an output having a value dependant on said lift pump dependent variable parameter, a low output value representing lift pumping in the presence of fuel and a high output value representing lift pumping in the absence of fuel;

a switching circuit electrically connected to receive said output and actuate said relay from said first condition to said second condition when said output value is above a predetermined threshold value; and a compact housing enclosing said relay, measuring circuit and switching circuit and including leads electrically connectable to said motor and said power supply.

8. The protected system of claim 7 comprising a high pressure fuel pump fluidly disposed between said lift pump and said engine.

9. The protected system of claim 7 comprising a delaying circuit (C2) electrically connected to said measuring circuit to delay actuation of said relay for a predetermined time interval when said output remains above said threshold value for said time interval.

10. A method of protecting a fuel supply pump for a diesel internal combustion engine having a direct current electrical system, said pump driven by a direct current electrical motor that is selectively connectable by a bistable relay with a normally resident first state which electrically isolates said motor from said electrical system and an actuated second state which electrically connects said motor to said electrical system, said method comprising:

defining a first variable parameter, said first variable parameter comprising a voltage at an electronic shut off solenoid terminal, said voltage indicating an engine run status;

defining a second variable parameter, said second variable parameter comprising a voltage at an oil pressure switch terminal, said voltage indicating adequate oil pressure;

obtaining a respective measured value said first and second variable parameters;

comparing each said measured value to a respective predefined value to determine engine run status and the presence or absence of adequate oil pressure; and actuating said relay to said second state if said comparing indicates that either the engine is running or adequate oil pressure is present.

11. The method of claim 10, further comprising:

de-actuating said relay after a predetermined period of time in the absence of adequate oil pressure.

12. The method of claim 11, wherein said step of de-actuating comprises:

using an RC network to decay said first voltage below said predefined value, whereby the value of said second variable parameter determines whether said relay will be de-actuated.

13. A lift pump guard for a lift pump adapted for use with a diesel engine having a solenoid activated electric shutoff (ESO) and an oil pressure switch, said ESO including a first terminal having a first voltage during diesel engine operation and a second voltage when the engine is not operating, said oil pressure switch having a second terminal having a third voltage when a predetermined level of oil pressure is reached in said diesel engine and a fourth voltage when said predetermined level of oil pressure is not present, said predetermined level of oil pressure being achieved after a known period of engine operation, said lift pump operable by a direct current motor selectively connected to a direct current power supply, said lift pump guard comprising:

a bistable relay electrically disposed between said motor and power supply with a normally resident first condition which electrically isolates said power supply and said motor and a selectively actuatable second condition which electrically connects said power supply and said motor;

means for detecting a voltage at said first terminal, comparing said voltage to a predetermined standard, and generating a first output voltage at a first output pin when said first voltage is detected and a second output voltage at said first output pin when said second voltage level is detected;

means for detecting a voltage at said second terminal, comparing said voltage to a predetermined standard, and generating a third output voltage at a second output pin when said third voltage is detected and a fourth output voltage at said second output pin when said fourth voltage is detected;

relay actuation means responsive to the voltage on said first and second output pins for actuating said relay;

wherein said relay actuation means actuates said relay when either said first output voltage is on said first output pin or said third output voltage is on said second output pin, whereby said motor is electrically connected to the power supply only when said diesel engine is operating or said predetermined level of oil pressure is achieved.

14. The guard of claim 13 further including a manually activatable means for actuating said relay to said second condition.

15. The guard of claim 14 wherein said means for comparing independently compares each said value to a respective preestablished value.

16. The lift pump guard of claim 13, wherein said means for detecting voltage at said first terminal includes components which translate said first voltage to said second voltage over a predetermined period of time approximatly equal to said known period of engine operation, so that said first output voltage is present a said first output pin at least until said third output voltage is present on said second output pin, whereby said relay is actuated initially by the presence of said first voltage and is held actuated so long as said second voltage appears before the expiration of said predetermined period of time and said relay remains actuated so long as said second voltage is present.

* * * * *